US005628042A

United States Patent [19]

Less

[11] Patent Number: 5,628,042

[45] Date of Patent: May 6, 1997

[54] SOLENOID CONTROLLED SHEET REGISTRATION MECHANISM

[75] Inventor: Krzysztof J. Less, London, England

[73] Assignee: Xerox Corporation, Stamford, Conn.

[21] Appl. No.: 375,441

[22] Filed: Jan. 19, 1995

[51] Int. Cl.[6] ..... G03G 21/14; G03G 15/00

[52] U.S. Cl. ..... 399/78; 399/394

[58] Field of Search ..... 355/317, 308, 355/309; 271/10, 10.01; 399/78, 394

[56] References Cited

U.S. PATENT DOCUMENTS

| | | | |
|---|---|---|---|
| 4,302,093 | 11/1981 | Landa | 355/274 |
| 4,350,329 | 9/1982 | Holzhauser et al. | 271/9.09 |
| 4,436,404 | 3/1984 | Simmons et al. | 355/319 |
| 4,529,188 | 7/1985 | Sturnick | 271/10.12 |
| 4,704,655 | 11/1987 | Yamauchi | 361/159 |
| 5,085,418 | 2/1992 | Rapkin et al. | 271/3.02 |

FOREIGN PATENT DOCUMENTS 0298737 11/1989 European Pat. Off. .

OTHER PUBLICATIONS

EPO Search Report.

*Primary Examiner*—William J. Royer
*Attorney, Agent, or Firm*—Kevin R. Kepner

[57] ABSTRACT

A solenoid-controlled sheet registration mechanism for a copier/printer includes registration fingers for registering the lead edge of a sheet before it is fed to the transfer station of the copier/printer, to receive a developed image from the photoreceptor. The mechanism also includes a pair of nip rolls for forwarding the sheet to the transfer station, after registration. Energization of the solenoid moves the registration fingers into the registration position and disengages the nip rolls. Conversely, release of the solenoid allows the registration fingers to return to a non-registration position and the nip rolls to return to paper-feeding engagement, both of those return movements taking place under a resilient bias. To soften the impact between the nip rolls as they re-engage, and so reduce any resulting noise, the release of the solenoid is controlled by applying a pulsed drive signal to the solenoid during the release period after the energizing signal has ceased.

14 Claims, 5 Drawing Sheets

SOLENOID CONTROLLED SHEET REGISTRATION MECHANISM

The present invention relates to solenoid-controlled mechanisms and is particularly applicable to solenoid-controlled sheet registration mechanisms used in sheet feeding paths, for example in electrophotographic copiers and printers.

Solenoid-controlled mechanisms can generate an undesirable amount of noise when in operation. The noise can, for example, be caused when components which have been moved by operation of a solenoid are allowed to return to a previous position under the action of a resilient bias when the solenoid is released.

In one known form of sheet registration mechanism, a solenoid is used to control not only the movement of registration fingers but also the engagement of associated nip rolls for transporting a sheet out of the registration mechanism. More particularly, operation of the solenoid moves the registration fingers into the sheet path against the action of at least one respective spring and also moves associated nip rolls out of engagement with each other against the action of at least one respective spring, while release of the solenoid allows the registration fingers and nip rolls to be returned by the respective springs to their original positions. The resilient bias on the nip rolls is comparatively strong to ensure that the nip rolls are clenched tightly together when transporting a sheet out of the registration mechanism: consequently, the rolls move together rapidly when the solenoid is released and the resulting impact can generate undesirable noise.

It is an object of the present invention to enable noise generated by solenoid-controlled mechanisms, and particularly solenoid-controlled sheet registration mechanisms, to be reduced.

The present invention provides a solenoid-controlled mechanism as claimed in any one of the accompanying claims.

By way of example only, embodiments of the invention will be described with reference to the accompanying drawings, in which:

FIG. 4 is controlled by a software control program.

Figure 1:
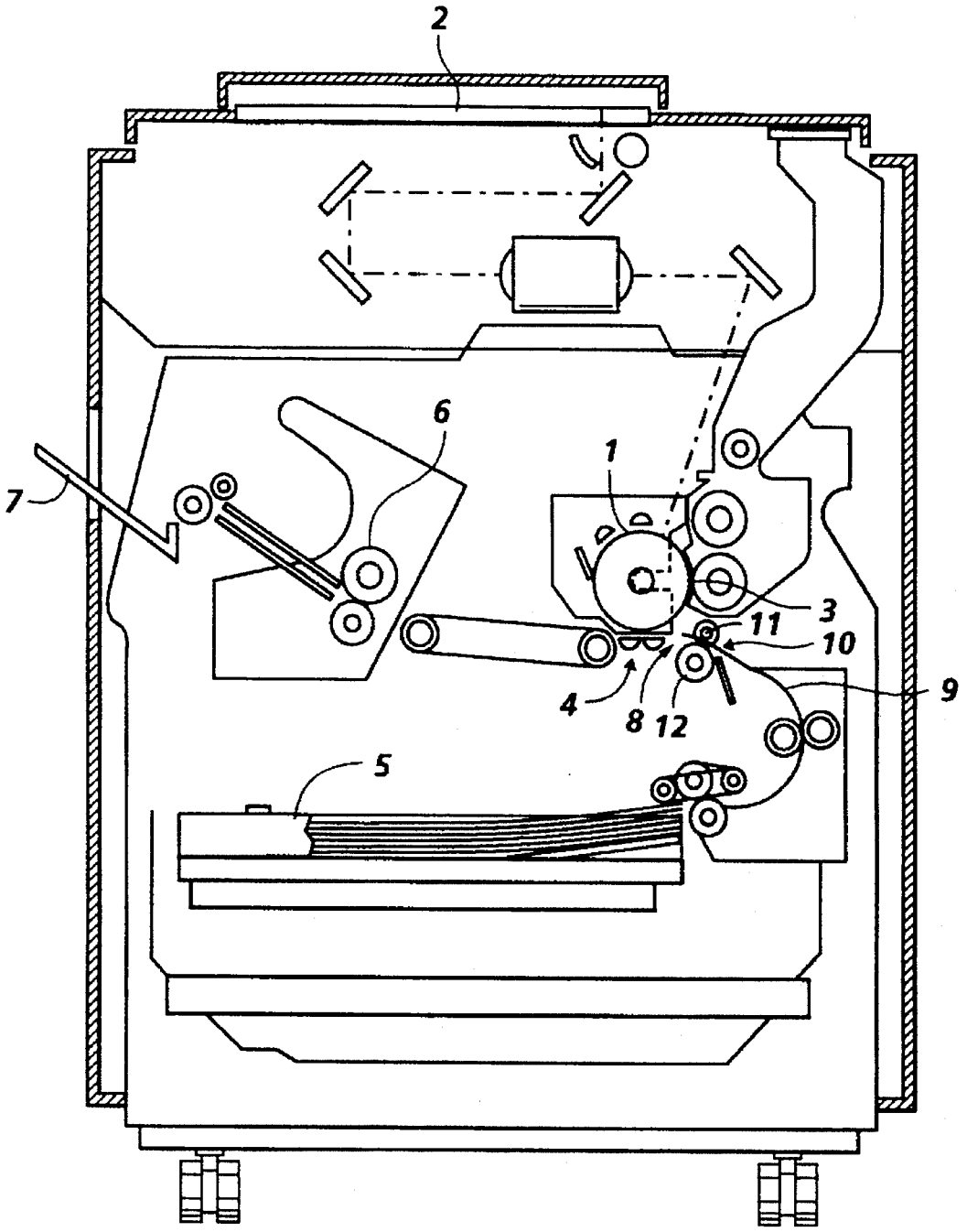
FIG. 1 is a schematic side elevation of a copier.

The copier shown in FIG. 1 is generally conventional and will, therefore, not be described in great detail. The copier has a photoreceptor 1, shown as being a rotatable drum, on which is formed an electrostatic latent image of an original document positioned on the copier platen 2. As the photoreceptor 1 rotates, the latent image is developed with toner at a development station 3 and the developed image is transferred, at a transfer station 4, to a copy sheet supplied from a paper tray 5. The copy sheet, carrying the transferred image, is then transported to a fusing station 6 where the image is fixed to the copy sheet before the latter is fed to an output tray 7.

Typically, the copier would also include an automatic document handler for feeding original documents to the platen 2; a user interface enabling a user to select an appropriate copying operation; a high-capacity feeder from which copy sheets can be fed to the transfer station 4, enabling the tray 5 to be used, for example, for special copy sheets only; and, instead of the output tray 7, an output device or finisher.

A copy sheet which is supplied from the tray 5 (or the high-capacity feeder, when present) is registered at a registration station 8 before being fed to the transfer station 4. The purpose of registration is to remove any skew from the sheet and also to ensure that the sheet is fed to the transfer station 4 in synchronism with the developed image on the photoreceptor 1. One mechanism that can be used to register sheets at the registration station 8 is shown in greater detail in FIGS. 2 and 3.

Figure 2:
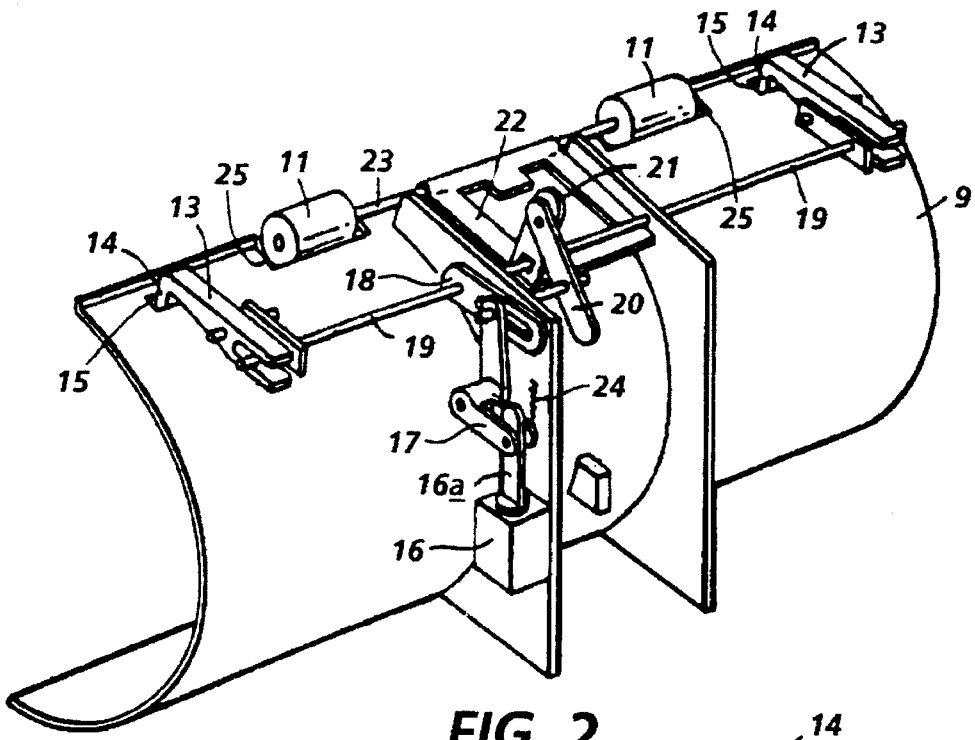
FIG. 2 is a perspective view showing a sheet registration mechanism suitable for use in the copier.

Sheets from the tray 5 are fed to the registration station 8 around the inside of a curved guide 9, shown in FIG. 1 and also in FIG. 2. If the copier also has a high-capacity feeder, sheets from the feeder are not fed around the guide 9 but are fed to the registration station 8 via a slot (not shown) near the top of the guide. The registration mechanism includes a registration nip 10 (FIG. 1) comprising two pinch rolls 11 which are movable into and out of engagement with respective drive rolls 12 (not shown in FIGS. 2 and 3). Registration fingers 13 (not shown in FIG. 1) are mounted one on each side of the pinch rolls 11 and are movable between an operative position, in which the tips 14 of the fingers project through slots 15 in the curved guide 9 into the sheet path, and a retracted position, in which the fingers are raised out of the sheet path. The pinch rolls 11 and the fingers 13 are actuated through a series of linkages, described in greater detail below, by a solenoid 16 so that they operate in the following manner.

Before a sheet arrives at the registration station 8, the pinch rolls 11 are disengaged from the drive rolls 12 and the fingers 13 are in the operative position. The lead edge of an incoming sheet encounters the tips 14 of the fingers 13 and, as the sheet is driven against the fingers, any skew in the sheet is removed. The pinch rolls 11 are then moved into engagement with the sheet and the fingers 13 are retracted, following which the drive rolls 12 are actuated to feed the sheet to the transfer station 4. After the sheet has been fed through the registration nip 10, the fingers 13 are lowered back into the paper path behind the trail edge of the sheet, and the pinch rolls 11 are then disengaged from the drive rolls 12.

Figure 3:
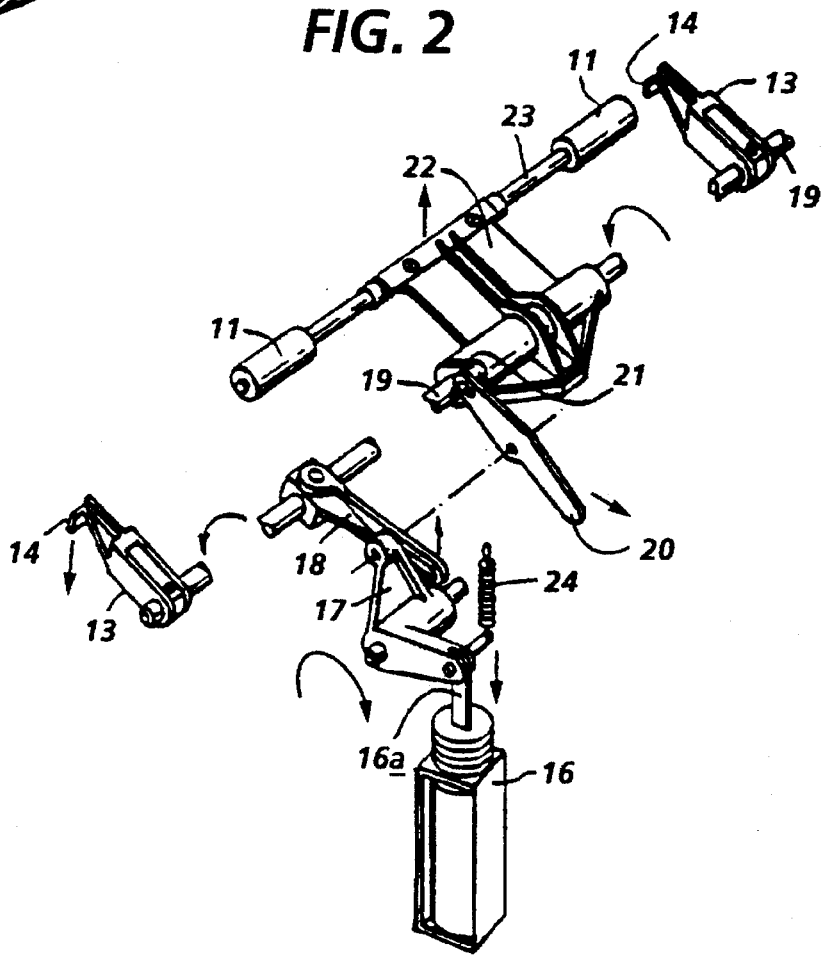
FIG. 3 is an exploded view showing the components of the sheet registration mechanism of FIG. 2.

The solenoid 16 is coupled to the fingers 13 by linkages 17, 18 connected, respectively, to the solenoid plunger 16*a* and to a rod 19 on which the registration fingers are mounted. The fingers 13 are biased into the raised position by the return spring 24 of the solenoid but, when the solenoid is energized (retracting the plunger 16*a* against the action of the spring 24) the rod 19 rotates in a counterclockwise direction (as seen in FIG. 3) and causes the fingers to move against the bias so that the tips 14 move down through the slots 15 in the curved guide 9 and into the paper path.

Further links 20, 21 connect the link 17 to a support bracket 22 in which the axle 23 of the pinch rolls 11 is mounted, the bracket being biased by a spring (not shown)

into a lowered position in which the pinch rolls 11 engage the drive rolls 12 through slots 25 in the curved guide. When the solenoid 16 is energized, the bracket is rotated against the action of that spring to lift the pinch rolls 11 away from the drive rolls 12.

The various linkages are so arranged that, in the first part of the movement produced by energization of the solenoid 16, the tips of the fingers 13 move into paper path before the pinch rolls 11 are raised and, conversely, when the solenoid is released, the pinch rolls 11 are lowered before the fingers 13 are raised. Energization of the solenoid occurs in response to the detection by a sensor (not shown) of a sheet moving around the curved guide 9 (or, when a high-capacity feeder is present, in response to the detection by a sensor (also not shown) of a sheet being fed through the previously-mentioned slot in the guide), and the subsequent release of the solenoid occurs in response to a timed signal generated by the controlling logic of the copier.

Figure 4:
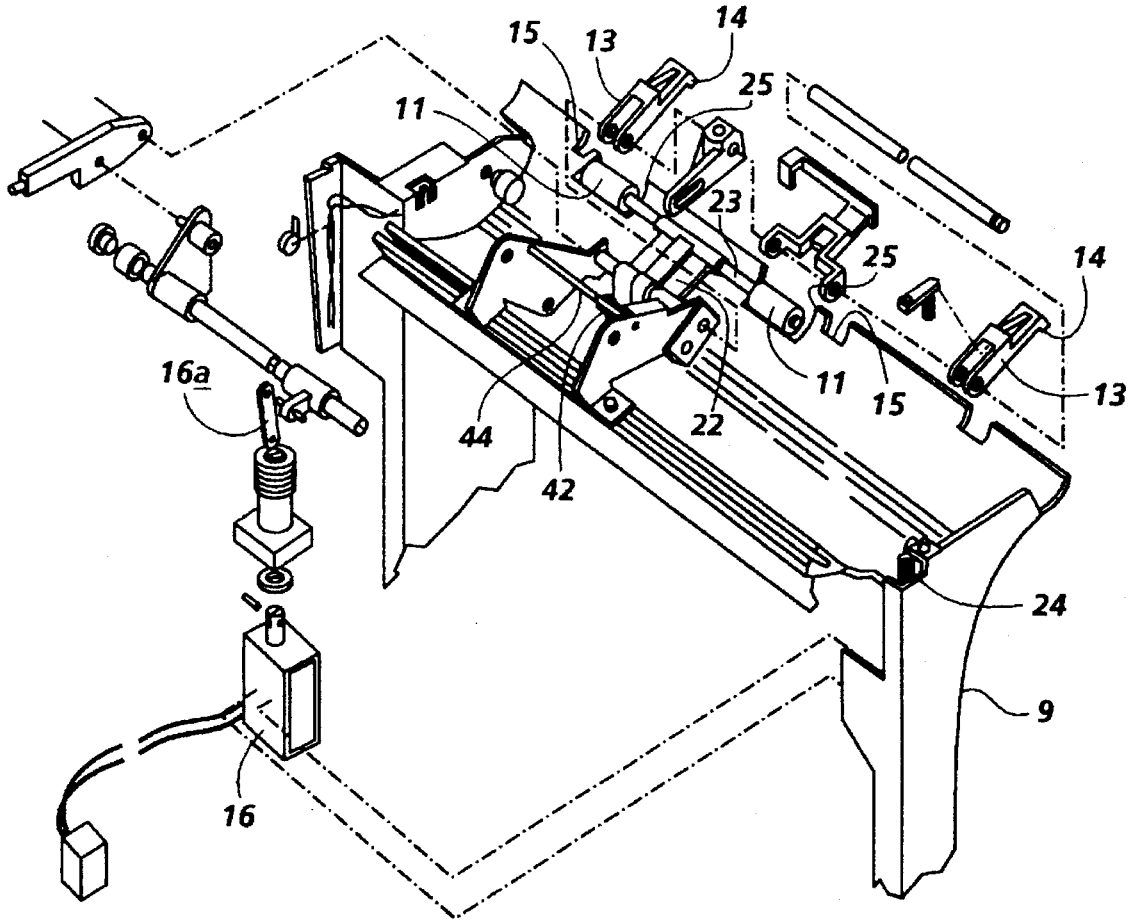
FIG. 4 is an exploded view showing the arrangement of the components in another sheet registration mechanism suitable for use in the copier of FIG. 1.

FIG. 4 shows another sheet registration mechanism, comprising essentially the same components as the mechanism shown in FIGS. 2 and 3 but in a different arrangement. Components that correspond directly to those of FIGS. 2 and 3 carry the same reference numerals. The guide 9 which directs sheets to the image transfer station (from a paper tray or high-capacity feeder, as the case may be) has a different shape from that of FIG. 2; and the particular form of the linkage from the solenoid plunger 16*a* to the registration fingers 13 and to the support bracket 22 of the pinch rolls 11 is also different, as is the shape and mounting of the support bracket 22. However, the mechanism functions in the same way as that shown in FIGS. 2 and 3. More particularly, when the solenoid 16 is energized, the solenoid plunger 16*a* is retracted against the action of the return spring 24 and initially causes the tips 14 of the registration fingers 13 to move down into the paper path through the slots 15 in the guide 9. Further movement of the plunger 16*a* causes the bracket 22 to rotate against the action of a spring (shown in FIG. 4 at 42) and lift the pinch rolls 11 away from the drive rolls 12 (FIG. 1). Conversely, when the solenoid is released, the pinch rolls 11 are lowered, under the action of the spring 42, to engage the drive rolls through the slots 25 in the guide 9 before the fingers 13 are raised under the action of the spring 24.

Figure 5:
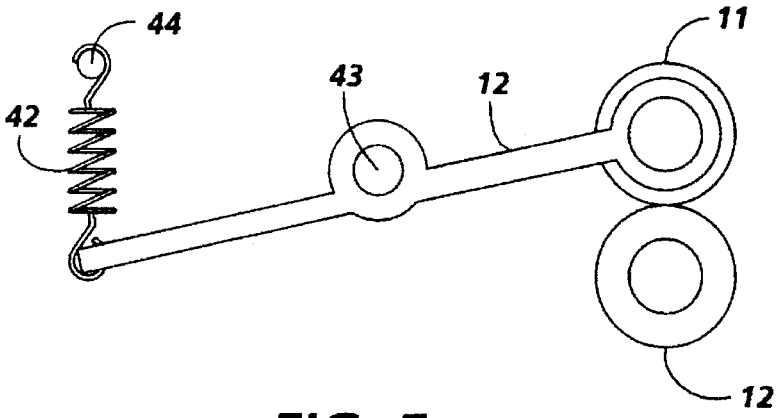
FIG. 5 is a diagrammatic illustration of part of the mechanism shown in FIG. 4.

The mounting of the bracket 22 of FIG. 4 is illustrated diagrammatically in FIG. 5. The bracket is pivotally-mounted on the rod 19 (see FIGS. 2 and 3) at a point 43 intermediate its two ends. The axle 23 (FIG. 4) on which the pinch rolls 11 are located is mounted in one end of the bracket 22 and the spring 42 is connected between the other end of the bracket and fixed pin 44 (also shown in FIG. 4).

Figure 6:
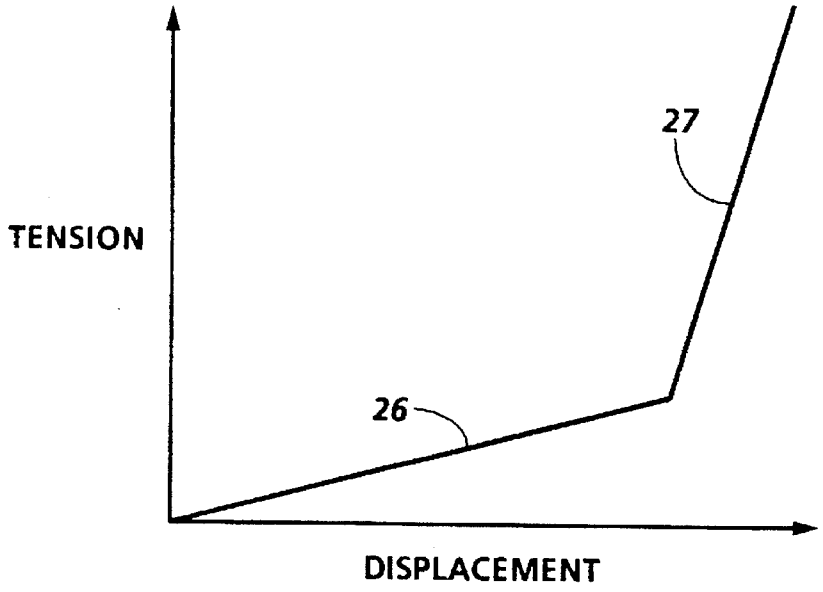
FIG. 6 illustrates the resilient forces acting in the sheet registration mechanism of FIG. 4.

FIG. 6 illustrates how the tension on the solenoid plunger 16*a* changes as the plunger is displaced when the solenoid is energized. There is a first region 26, covering most of the plunger displacement, in which the tension on the plunger increases comparatively slowly with the displacement and a second region 27, towards the end of the plunger displacement, in which the tension on the plunger increases comparatively rapidly. The first region 26 is caused by the comparatively weak return spring 24 of the solenoid, and the second region is caused by the comparatively strong spring (not shown in FIGS. 2 and 3 but shown at 42 in FIGS. 4 and 5) that acts on the pinch rolls 11. If the subsequent release of the solenoid 16 were unrestrained, the stored energy in the pinch roll spring 42 would cause rapid acceleration of the pinch rolls 11, which would impact the drive rolls 12 at a high enough velocity to generate a comparatively loud noise. To reduce that noise, the release of the solenoid 16 is controlled using the circuit shown in FIG. 7.

Figure 7:
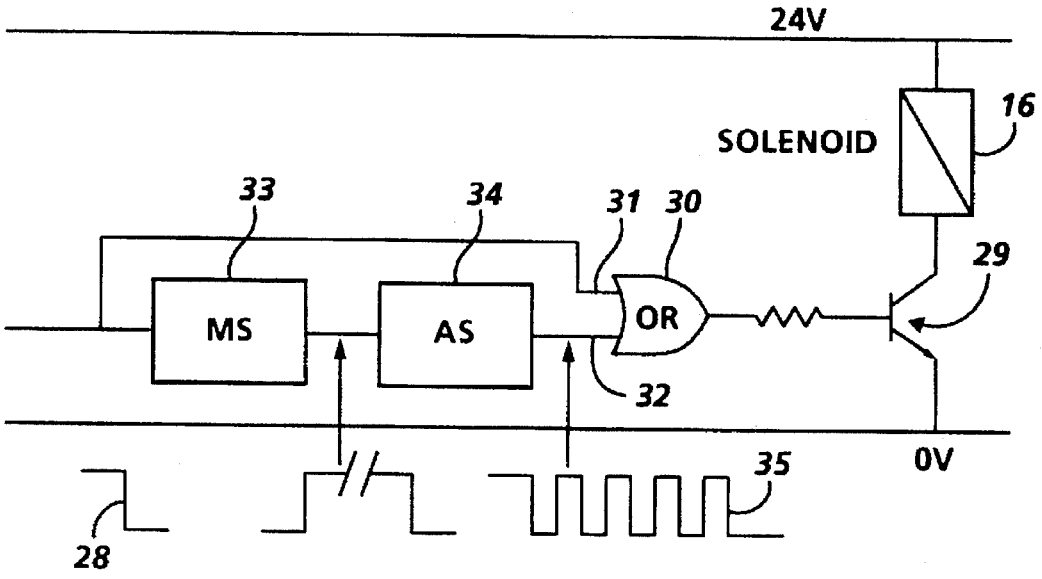
FIG. 7 is a diagram of the electrical control circuit of the solenoid of the sheet registration mechanism of FIG. 2 or FIG. 4.

The circuit shown in FIG. 7 causes the drive to the solenoid 16 to be stepped-down in a controlled manner, rather than cut abruptly. The energizing signal 28 for the solenoid is applied to the solenoid drive transistor 29 via an OR gate 30. The energizing signal 28 is applied to one input 31 of the OR gate directly and to the other input 32 via a monostable circuit 33 and an astable multivibrator 34. On commencement of the signal 28, the solenoid 16 is energized immediately via the input 31 of the OR gate. When the energizing signal 28 ceases, the monostable circuit 33 is fired and causes the astable multivibrator 34 to generate a pulse train 35 which is applied to the solenoid drive transistor 29 via the input 32 of the OR gate. The pulse train 35 continues to be applied to the transistor 29 until the monostable circuit 33 times out and disables the astable multivibrator 34. The pulse train 35 causes the solenoid 16 to be released in steps so that the pinch rolls 11 move more slowly towards the drive rolls 12 and a noisy impact is avoided. A pulse train having an ON/OFF ratio of 1 ms/4 ms has been found to be particularly effective but the ON/OFF ratio would, of course, be adjusted to suit the characteristics of the registration mechanism. Pulsing at too slow a rate will result in a less controlled release of the solenoid and be less effective at reducing noise, while pulsing at a higher rate (i.e. shorter pulses at a higher frequency) will result in the solenoid remaining partly-energized because it will behave as if a lower, continuous, current were passing through it rather than a series of pulses.

Alternative methods could be used to apply a pulse train 35 to the solenoid drive transistor 29 to control the release of the solenoid 16 when the energizing signal 28 has ceased. The gradual release of the solenoid 16 could, for example, be achieved as described below with reference to FIG. 8 using a pulse train 35 that is generated by means of a software control program, forming part of an overall control program used by the microprocessor that controls the operation of the copier. The circuit hardware 30, 33, 34 shown in FIG. 7 would then be unnecessary.

Figure 8A:
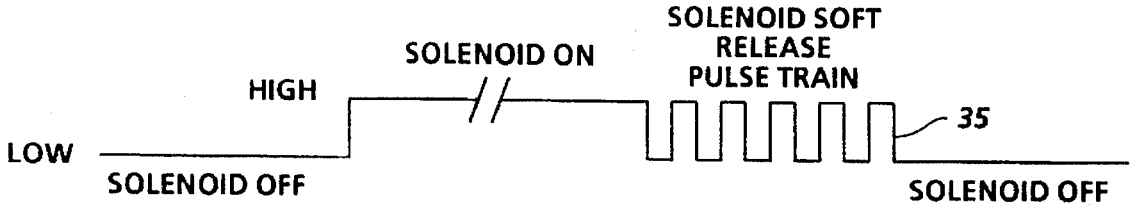
FIG. 8A illustrates waveforms generated when the solenoid of the sheet registration mechanism of FIG. 2
Figure 8B:
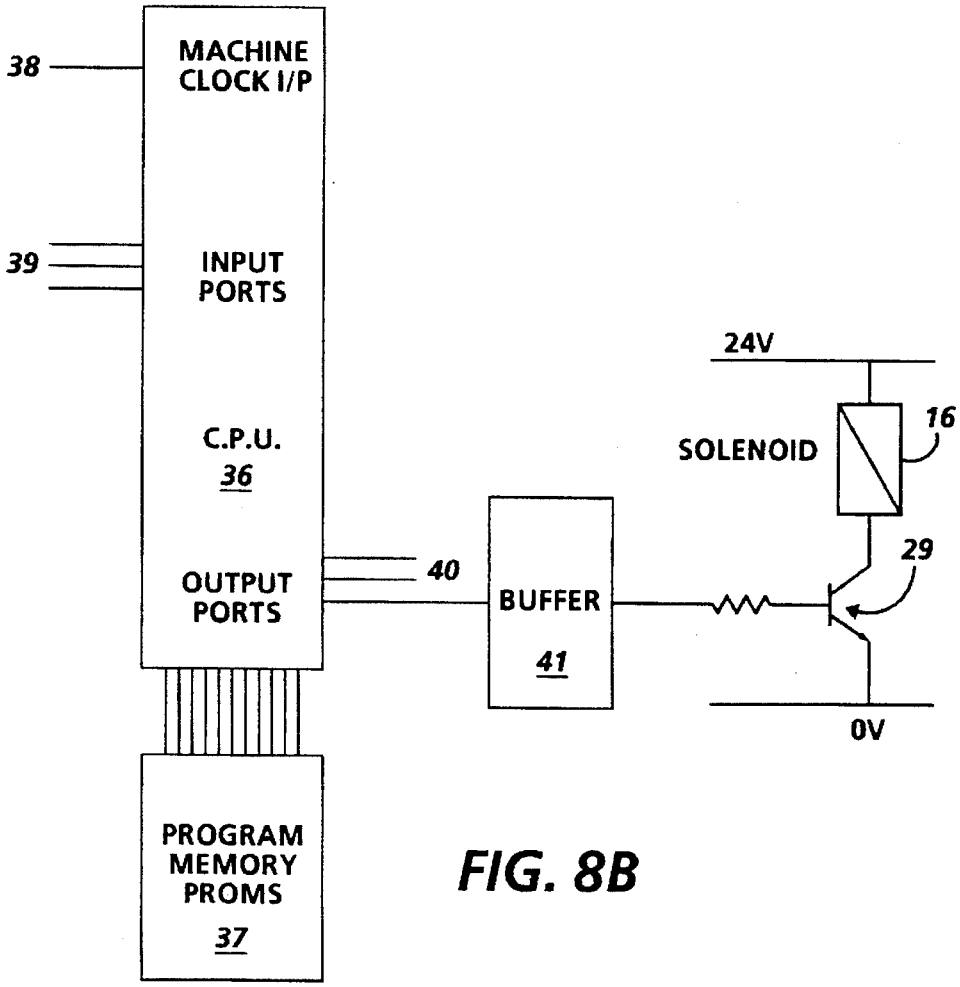
FIG. 8B illustrates the control arrangement for generating the waveforms of FIG. 8A.

Referring to FIG. 8A and B, the major functions of the copier are controlled by a Central Processing Unit (Microprocessor) C.P.U. 36. The instructions for the C.P.U. are contained in the Program Memory PROMs. 37 in the form of a Control Program written specifically for the photocopier. The actions of the C.P.U. 36 are synchronized to the motion of the components of the photocopier by a Machine Clock Input 38 which consists of a train of pulses derived from a shaft encoder on one of the shafts of the photocopier. The period of the Machine Clock Input pulses is about 2 mS. In addition the C.P.U. 36 has a number of Input Ports 39 through which it receives (digital) data on the status of a number of sensors located in the machine. One example of such a sensor is the sensor (previously mentioned) that detects the movement of a sheet of paper around the guide 9 of FIGS. 2 and 4. The status of the inputs at the Input Ports 39, the train of pulses at the Machine Clock Input 38, and the set of instructions contained in the Program Memory PROMs 37, together, determine the outputs of a number of digital Output Ports 40 of the C.P.U. 36. The outputs present at the Output Ports 40 are used to control various components of the copier (motors, clutches, lamps, solenoids, etc.) to enable the copier to perform its functions. One such output is fed via buffer circuits 41 to the solenoid driver transistor 29 and used to control operation of the solenoid 16 (FIGS. 2 to 4) of the registration mechanism.

To energize the solenoid 16, the control program applies a high level input to the solenoid driver transistor 29. When the solenoid 16 is to be released, the control program applies the pulse train 35 to the solenoid driver transistor 29 as shown schematically in FIG. 8A. This reduces the average current flowing through the solenoid winding to a level where the pull of the solenoid is insufficient to overcome the restoring action of the springs 24, 42, causing the components controlled by the solenoid 16 to return to their relaxed positions in a controlled manner. The form of the pulse train 35 is contained within the control program that resides in the Program Memory PROMs 37. The pulse train 35 continues for a time sufficient to allow the components controlled by the solenoid 16 to return to their relaxed positions, after which the solenoid 16 is rendered fully released by applying a continuous low level signal to the solenoid driver transistor 29.

It will be appreciated that, although the use of a pulsed signal 35 to control release of a solenoid has been described in the context of a sheet registration mechanism, a similar method could be used in any context in which controlled release of a solenoid is required (whether for reducing noise or for some other reason). It will also be appreciated that, although the sheet registration mechanisms shown in FIGS. 2 to 4 have been described in the context of a copier, they could, for example, also be used in electrophotographic printers.

I claim:

1. A printing machine having a solenoid actuated mechanism for registering sheets in a sheet feeding path, the registration mechanism comprising:

a sheet registration member connected to the solenoid;

a signal generator to generate an electrical signal to energize the solenoid; and a pulse signal generator to generate a predetermined pulsed signal to the solenoid in response to said signal generator generating an electrical signal to de-energize the solenoid as said registration member moves from a registration position in the sheet feeding path to arrest the lead edge of a sheet moving along the sheet feeding path to a nonregistration position spaced from the sheet feeding path wherein the pulsed signal minimizes noise and abrupt contact by damping the solenoid as said registration member is moved out of the sheet feeding path.

2. A printing machine according to claim 1, further comprising means for resiliently-biasing said registration member to move to the nonregistration position in response to the solenoid being deenergized.

3. A printing machine according to claim 2, wherein said registration member comprises a gate, movable from a registration position in the sheet path to a retracted position, out of the sheet path.

4. A printing machine according to claim 2, wherein said pulse generator comprises a central processing unit operating in accordance with a set of preprogrammed instructions to generate the energizing signal and to then generate the pulsed signal upon termination of the energizing signal.

5. A printing machine having a solenoid actuated mechanism for registering sheets in a sheet feeding path, the registration mechanism comprising:

a sheet registration member connected to the solenoid;

a signal generator to generate an electrical signal to energize the solenoid;

a pulse signal generator to generate a predetermined pulsed signal to the solenoid in response to said signal generator generating an electrical signal to de-energize the solenoid as said registration member moves from a registration position in the sheet feeding path to arrest the lead edge of a sheet moving along the sheet feeding path to a nonregistration position spaced from the sheet feeding path;

an idler member; and a resiliently-biased roll, said roll movable between a first position, in circumferential contact with said idler member so as to form a nip therebetween, and a second position, out of contact with said idler member, said roll being operatively connected to the solenoid so that upon energization of the solenoid, the registration member moves into the registration position before the resiliently-biased roll moves away from said idler member and, on release of the solenoid, the resiliently-biased roll moves into engagement with said idler member before said registration member moves out of the registration position.

6. A printing machine according to claim 4, wherein said idler member comprises a second roll adapted to circumferentially contact said first mentioned roll.

7. A printing machine according to claim 5, wherein said first mentioned roll is a drive roll and said second roll is an idler roll.

8. A printing machine according to claim 6, wherein said registration member, said first roll and said second roll are located in the sheet path so as to register and forward a sheet in synchronism with a photoreceptive member having an image developed thereon.

9. A solenoid control mechanism, comprising:

a signal generator to generate an electrical signal to energize the solenoid; and a pulse signal generator to generate a predetermined pulsed signal to control the release of the solenoid in response to said signal generator generating a deenergizing signal wherein the pulsed signal minimizes noise and abrupt contact by damping the solenoid as the solenoid is deenergized.

10. A solenoid control mechanism according to claim 9, further comprising a resiliently biased component wherein the solenoid is connected to said resiliently biased component so that energization of the solenoid moves said component against the bias.

11. A control mechanism according to claim 10, wherein release of the solenoid causes said resiliently biased component to move under the resilient bias.

12. A solenoid control mechanism, comprising:

a signal generator to generate an electrical signal to energize the solenoid; and a pulse signal generator to generate a predetermined pulsed signal to control the release of the solenoid in response to said signal generator generating a deenergizing signal, wherein said pulse signal generator comprises an astable multivibrator circuit and a monostable circuit connected to receive the energizing signal and operable in response to the deenergizing signal to apply an operating signal to said astable multivibrator circuit.

13. A mechanism according to claim 10, further comprising an OR gate having a first input, a second input and an output, in which said signal generator is connected to a first input of said OR gate, said monostable circuit being connected to said signal generator and said astable multivibrator circuit, the second input of the OR gate being connected to receive the operating signal from said astable multivibrator circuit, the output of the OR gate being connected to a drive transistor of the solenoid.

14. A solenoid control mechanism, comprising:

a signal generator to generate an electrical signal to energize the solenoid; and a pulse signal generator to generate a predetermined pulsed signal to control the release of the solenoid in response to said signal generator generating a deenergizing signal, wherein said pulse generator comprises a central processing unit operating in accordance with a set of preprogrammed instructions to generate the energizing signal and to then generate the pulsed signal upon termination of the energizing signal.

* * * * *